US006866045B1

(12) United States Patent
Maillard et al.

(10) Patent No.: US 6,866,045 B1
(45) Date of Patent: Mar. 15, 2005

(54) FILTRATION METHOD AND FILTER CONSISTING OF NITROGEN-CONTAINING CYCLES OR HETEROCYCLES SUCH AS DNA OR RNA

(75) Inventors: Frederic Maillard, Paris (FR); Guy Hadad, Paris (FR)

(73) Assignee: Sun Zero, Paris (FR)

( * ) Notice: Subject to any disclaimer, the term of this patent is extended or adjusted under 35 U.S.C. 154(b) by 0 days.

(21) Appl. No.: 10/088,007

(22) PCT Filed: Sep. 8, 2000

(86) PCT No.: PCT/FR00/02493

§ 371 (c)(1),
(2), (4) Date: Jun. 24, 2002

(87) PCT Pub. No.: WO01/19210

PCT Pub. Date: Mar. 22, 2001

(30) Foreign Application Priority Data

Sep. 13, 1999 (FR) ..... 99 11552

(51) Int. Cl.[7] ..... A24D 3/14

(52) U.S. Cl. ..... 131/334; 131/331; 131/332; 131/200; 131/202

(58) Field of Search ..... 131/331, 332, 131/341, 345, 200, 202, 334; 493/39

(56) References Cited

U.S. PATENT DOCUMENTS

| | | | | |
|---|---|---|---|---|
| 3,982,897 | A | 9/1976 | Scheinberg | 23/232 |
| 4,498,485 | A | 2/1985 | Carter | 131/331 |
| 4,735,218 | A | 4/1988 | Akiko et al. | 131/331 |
| 5,909,736 | A | 6/1999 | Stavridis et al. | 131/331 |

FOREIGN PATENT DOCUMENTS

| | | |
|---|---|---|
| EP | 0 058 463 A1 | 8/1982 |
| GB | 2 155 756 A | 10/1985 |
| WO | WO 98/15197 | 4/1998 |

*Primary Examiner*—Dionne A. Walls
(74) *Attorney, Agent, or Firm*—Westman, Champlin & Kelly, P.A.

(57) ABSTRACT

The methods concerns a method for general use and more particularly used for tobacco products. The method uses in particular nitrogen-containing heterocycles such as DNA and RNA bases and complementarily polymer fibers. Said molecules and said fibers can partly halogenated, or in halogenated salt media. The halogen is preferably fluorine. Fluorine may be added to may bei n the form of a medium of fluorinated salts such as NaF, KF, $Na_2PO_3F$. The filtering acts against the formation of human intracellular DNA or RNA adducts, while preserving the nicotine and the tobacco aromas.

18 Claims, 1 Drawing Sheet

FILTRATION METHOD AND FILTER CONSISTING OF NITROGEN-CONTAINING CYCLES OR HETEROCYCLES SUCH AS DNA OR RNA

CROSS-REFERENCE TO RELATED APPLICATIONS

This application is a Section 371 national stage application of International Application No. PCT/FR00/02493, filed Sep. 8, 2000, published Mar. 22, 2001 as WO01/19210 not in English.

FIELD OF THE INVENTION

The present invention relates to a filtration method and to a filter of general use, notably applicable to tobacco products, and notably for the filter stub of a cigarette. More specifically, the object of the invention is to protect molecules of the human genome against carcinogenic toxic substances from the inhaled smoke.

BACKGROUND OF THE INVENTION

Cigarette filters known today generally contain polysaccharide derivatives, either of natural origin or thermoplastic, polyesters, such as polyethylene and polypropylene terephthalate. Patents EP 434332 and EP 434339 of RJ. Reynolds Tobacco Cie describe such filters, they may also contain dried tobacco grains. The use of salts, acids, bases, surfactants in a medium with a basic pH, is mentioned in these various patents.

More specifically against carcinogenic substances, patent WO 96/00019 describes a cigarette filter enriched with $Fe^{++}$, $Cu^{++}$ or $Mg^{++}$ ions. The purpose is to retain free radicals and especially protect metalloproteins.

Patent WO 96/10929 describes an inhibitor of free radicals, such as an O-alkylated derivative of 2,4-monofurfurylidene sorbitol, associated with an antioxidant, the action of which is to filter polycyclic aromatic hydrocarbons (PAH), mainly 3,4-benzo-(a)-pyrene (BaP) with known carcinogenic potency.

Moreover, it is known that fluorine has antitumoral effects. Notably, it is involved in the composition of dexamethasone and 5-fluorouracil. Further, the use of laboratory polytetrafluoroethylene (PTFE) filter paper is known.

SUMMARY OF THE INVENTION

The filtration method according to the invention has a selective, direct chemical, anti-carcinogenic action. It is intended to filter toxic products, in particular polycyclic aromatic hydrocarbons (PAH) such as benzo-(a)-pyrene (BaP) and nitrosamines, contained in the tobacco smoke of a cigarette.

The filtration method comprises the step for controlling the level of toxic products as compared with that of nicotine in such a way that the reduction in level at the output of the filter is larger than a predetermined threshold. Thus, nicotine and taste aromas are preserved for the satisfaction and pleasure of smokers.

The selective action mode of the method according to the invention, as regards carcinogenic toxic products as compared with nicotine, is one of its main properties.

Its second main feature is its direct chemical action. That is its action towards carcinogenic toxic products at the actual reactive site of DNA.

Preferably, in order to control the level of toxic products, notably the level of polycyclic aromatic hydrocarbons (PAH) and nitrosamines, as compared with that of nicotine, the method according to the invention comprises the following steps:

- the step for scavenging all or part of the toxic products by means of an active ingredient acting on said toxic products according to molecular processes comparable to those according to which human cell DNA and/or RNA reacts towards said toxic products,
- the step for controlling the operating conditions of the filter by operating in a substantially non-aqueous medium with a basic pH, preferably larger than or equal to 8,
- the step for adjusting the mass of the active ingredient so that it is larger than or equal to 0.1% of the mass of the cigarette filter and preferably larger than or equal to 1% of the mass of the filter.

Attacks against DNA and/or RNA molecules of the human cell are chiefly the cause of cancer tumors. Therefore, by filtering the tobacco smoke with molecular mechanisms of the same nature as those which degrade DNA and/or RNA, carcinogenic toxic products contained in tobacco smoke are scavenged both selectively and directly.

The inventors have established that with the minimum amounts of active ingredient and under the aforementioned operating conditions, it is possible to control the level of toxic products, notably the level of polycyclic aromatic hydrocarbons (PAH) and nitrosamines, as compared with that of nicotine.

Preferably, said active ingredient consists of molecules formed by one or more nitrogen-containing cycles or nitrogen-containing heterocycles, preferably nitrogen-containing heteroaromatic cycles, notably pentacycles or hexacycles or a combination of both. Advantageously, according to the invention, said active ingredient should exist as:

- a chain of said molecules and/or
- said molecules in a common chemical arrangement, bound to a fiber such as a fiber consisting of cellulose acetate.

Preferably, the molecule of the active ingredient is DNA and/or RNA and/or a DNA or RNA derivative, as for example adenosine triphosphate (ATP), cyclic adenosine monophosphate (AMP), adenylcyclase.

The invention also relates to a cigarette filter implementing the method described above. The cigarette filter according to the invention has selective, direct chemical, anti-carcinogenic action. In particular, it is intended for filtering polycyclic aromatic hydrocarbons (PAH) and notably benzo (a)pyrene (BaP) as well as nitrosamines, while preserving the level of nicotine and the aromas of taste for the satisfaction and pleasure of smokers. The filter includes an active ingredient consisting of molecules formed by one or more nitrogen-containing cycles or nitrogen-containing heterocyles and particularly nitrogen-containing heteroaromatic cycles, notably pentacycles, or hexacyles or a combination of both. Advantageously, said active ingredient should exist as a chain of said molecules and/or said molecules bound to a fiber, notably a cellulose acetate fiber, in a common chemical arrangement. The mass of said nitrogen-containing cycles or heterocycles, in particular of the nitrogen-containing heteroaromatic cycles, is at least equal to or larger than 0.1% of the total mass of the filter. The medium in which operate said nitrogen-containing cycles or heterocycles and in particular nitrogen-containing heteroaromatic cycles, is a substantially non-aqueous medium with a basic pH. Under these operating conditions, it has been established that it is possible to substantially reduce, at the output of the filter, the level of polycyclic aromatic hydrocarbons, as compared to nicotine. The level may further be reduced by more than 90% while preserving the nicotine level and the taste aromas for the satisfaction and pleasure of the smoker. According to an alternative embodiment of the filter, other fibers of natural or artificial origin are also used, mainly aromatic derivatives of ethylene (for example, polyethylene terephthalate), of propylene (for example, polypropylene terephthalate) in a medium of fluorinated salts.

Advantageously, in an alternative embodiment of the invention, the molecules are formed as a polymer, in the broad sense.

Also advantageously, in another alternative embodiment of the invention, the active ingredient exclusively consists of molecules and/or said polymers.

Preferably, the mass of said nitrogen-containing cycles or heterocycles, and in particular nitrogen-containing heteroaromatic cycles, is at least equal to or larger than 1% of the total mass of the filter.

Advantageously, the moisture content of the filter lies between 5 and 10%.

Advantageously, the pH of the filter is larger than 8.

Preferably, the molecule of the active ingredient is DNA and/or RNA and/or a DNA or RNA derivative, such as for example, adenosine triphosphate (ATP), cyclic adenosine monophosphate or adenylcyclase.

Hence, the carcinogenic toxic products, contained in tobacco smoke, directly affecting the DNA and/or RNA molecules of the human cell, are selectively scavenged by the filter according to molecular processes comparable with those according to which said toxic products act on human cell DNA or RNA.

Advantageously, the molecule of the active ingredient is added, onto at least one of the nitrogen-containing cycles or nitrogen-containing heterocycles and in particular of the nitrogen-containing heteroaromatic groups, with at least one function selected from a group comprising the following functions:

amine $NH_2$, ketone, aldehyde, methyl, alkene, alkyl or aryl.

Advantageously, one or more sugars such as ribose or deoxiribose are added to at least one molecule of the active ingredient.

Advantageously, one or more acid functions, notably from pentavalent phosphoric acid ($H_3PO_4$) and/or another molecule including a trivalent phosphorus atom are added to at least one molecule of the active ingredient.

Advantageously, in the case of a chain of molecules, formed as a polymer, polymerization is performed in the broad sense at the nitrogen-containing cycles, i.e. at nitrogen-containing heterocycles and in particular nitrogen-containing heteroaromatic cycles and/or added functions and/or acids and/or sugars.

Advantageously, the molecule of the active ingredient includes one or more atoms and/or one or more molecules and/or one or more radicals and/or one or more halogen ions such as notably fluorine.

Advantageously, the molecule of the active ingredient is located in a medium containing halogenated salts, notably sodium fluoride (NaF) salts.

Advantageously, if said active ingredient exists as a chain of said molecules and/or said molecules bound to a fiber, said fiber is partly halogenated, such as notably with fluorine. Also advantageously in this case, said fiber, whether partly halogenated or not, is in a medium including halogen atoms, molecules, radicals or ions, such as notably fluorine.

The invention also relates to a method for manufacturing a filter including an active ingredient consisting of chains of molecules with the features defined above. Said method comprises the step for extruding and/or rolling together said chains of molecules. If said molecules are bound in a common chemical arrangement to fibers, notably cellulose acetate fibers, said manufacturing method comprises the step for extruding and/or rolling together said fibers.

The invention also relates to a filtering device of general application, including an active ingredient consisting of molecules and/or fibers with the above defined features and operating under the above conditions.

Advantageously, the filtering device according to the invention is such that said molecules and/or said fibers are incorporated into separate compartments, or exist as grains and/or filaments.

Advantageously, the filtering device according to the invention is such that said molecules and/or said fibers exist in a gelatinous, liquid or gaseous physical state.

The filtering device may be applied to selective filtration of toxic products. The filtering device according to the invention may be applied to selective purification of tobacco smoke, in order to preserve the usual levels of nicotine, for the satisfaction of the smoker, and those of tar containing the tobacco aromas, for preserving the taste.

The invention also relates to a cigarette including a filtering device such as the one described above. As shown in FIG. 2, the cigarette according to the invention includes a tobacco rod 2. A filtering device 1 such as the one described above is mounted on one of the ends of the rod 2.

DETAILED DESCRIPTION

Figure 1:
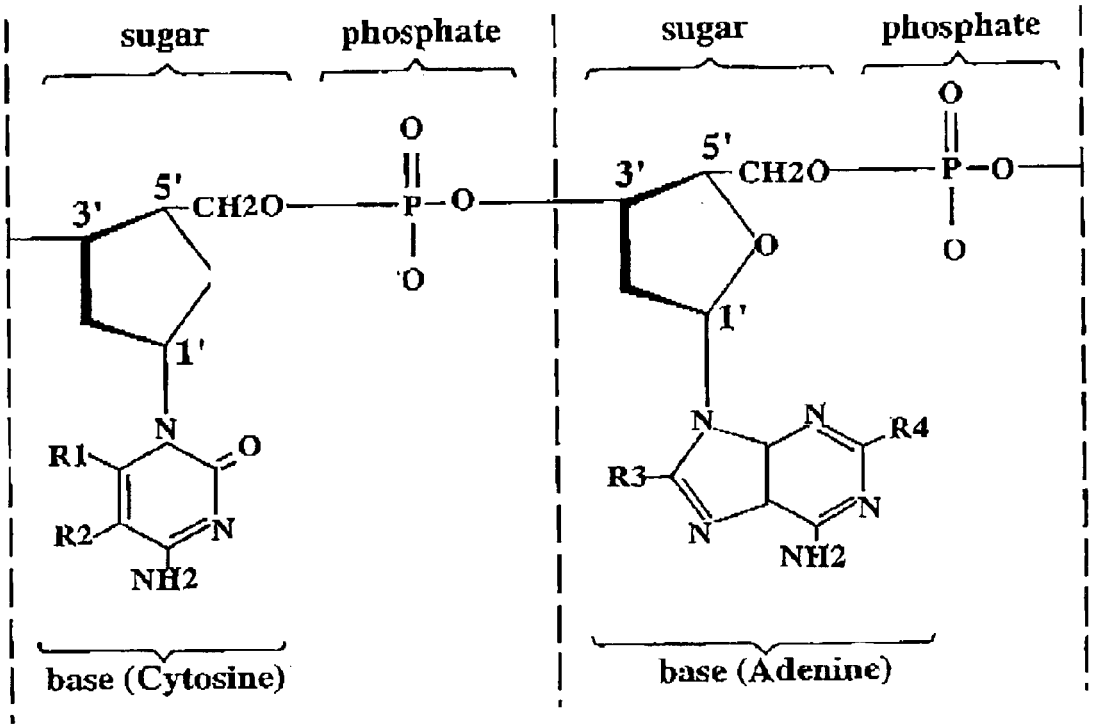
FIG. 1 illustrates an exemplary molecule according to the present invention.
Figure 2:
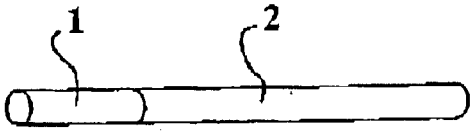
FIG. 2 illustrates a tobacco product, more particularly a cigarette, employing a filter according to an embodiment of the present invention.

The invention protects the molecules from the human genome against the carcinogenic toxic products from the tobacco smoke. Further, in the case of a smoking item, this filter has the particularity of preserving the usual nicotine levels and the tars of the aromas in their entirety. This low cost filter with maximum efficiency may be manufactured conveniently and industrially for the best of the smoker's satisfaction and pleasure by preserving the taste, while considerably alleviating the incurred risks, particularly in the field of bronchopulmonary and cardiovascular pathology.

The invention considered here, is for protecting the human genome against the attacks from carcinogenic products, the main process involved in the mechanism of initiation and promotion of the cancer phenomenon. The invention is less concerned about the indirect processes of cell attacks occurring at molecular level such as the metalloproteins or globulins involved in the immune response system.

In the case of a filter for a smoking item, carcinogenic etiogenesis depends on molecules which are not always originally located in the actual tobacco but which are intermediate pyrolysis derivatives formed along the rod of the cigarette through a cooling passageway up to the filter upon inhalation-suction.

These derivatives, either free radicals or carbocations, are electrophilic.

Henceforth, free radicals and carbocations are better known as genotoxic agents which change the rules for duplication of DNA and/or form adducts with it. They may also be responsible for disorders in the coding by DNA of proteins essential to the life of the cells.

The invention implements molecules with several nucleophilic nuclei which prevent electrophilic attack from these agents. According to the invention, these molecules by their amount present in the filter, filter out the toxic products, which would otherwise be doomed to have carcinogenic action in the body of the smoker either in situ, or in the liver of the smoker after a metabolization process.

In the human body, the compounds and radicals to be filtered out form potent adducts with DNA by penetrating the cell nuclei or, for pre-carcinogenic products, after having passed through bio-activating systems of the body, and give rise to mutagenic and carcinogenic processes.

It is known that the carcinogenic process most frequently involves electrophilic atoms in molecules for which transmembrane migration towards the cell nucleus is favored by a medium with positive electrical density.

According to the invention, molecules formed with nucleophilic dipoles, voltage forces, $\pi$ electron clouds which produce nucleophilic poles for attracting electrophilic compounds and radicals are used for filtering out these genotoxic precursor molecules.

During the tests, it was established that the components of the molecules of the filter according to the invention, and notably the DNA and RNA nucleotides, form an obstacle to the compounds and radicals to be filtered out, before they even reached the human genetic heritage.

FIG. 1 which illustrates the outline of an exemplary molecule according to the invention will now be described. Radicals R1, R2, R3 et R4 are amine, ketone, aldehyde, methyl, alkene, alkyl, aryl, functions, etc.

These functions, added to the molecule, may be used for filtering out alkyl or aryl epoxides, ester sulfates, nitrosamines, with direct carcinogenic potency.

These radicals R1, R2, R3 et R4 may also be one or more atoms or a radical of a halogen such as fluorine.

As an example, purine or pyrimidine type molecules may be produced as filaments, monocatenary strands obtained by DNA denaturation or as RNA strands, most frequently simple strands.

It is known that DNA or RNA may be obtained by growing microorganisms, by breaking up the nuclei and with a gel electrophoresis method.

The filter may use one or more halogens, preferably fluorine, as an atom, a molecule, a radical or an ion.

When used, fluorine may be added beforehand onto a possible precursor phenyl nucleus for the synthesis of the molecule according to the invention, via an inorganic acid, a Brönsted acid, or a Lewis acid.

In the case of a halogenation, the "polymer fever" or "influenza-like" syndrome will be avoided by proceeding with partial halogenation of the fibers.

The halogen salts used are preferably soluble salts of alkaline and alkaline earth metals, for example sodium fluoride.

The molecules according to the invention and/or the other fibers of the filter may be extruded or rolled together with the halogen salts, as for example in the manufacturing method described in Patent WO/24078 of Caredent Ltd.

Certain toxic products should be excluded, like carboxylic acids of fluorine or their precursors, in particular fluoroacetic acid as well certain dangerous organophosphorus compounds.

The halogen level used shall not exceed the threshold imposed by steps for restricting biodegradation and consumable fluorine level.

In the case of a halogenation, the filter may also have a distribution with a high fluorine content for the fibers of the molecules according to the invention and/or for the other fibers of the filter, and then with a lesser fluorine content from the middle towards the periphery of the filter or vice versa, or in distinct compartments positioned along the length of the filter.

The filter, as described here, has the function of filtering out electrophilic compounds and radicals more efficiently, such as polycyclic aromatic hydrocarbons (PAH)—and especially BaP—and nitrosamines.

The filter also includes in certain alternative embodiments, surface-active solvents or other materials (inorganic or carboxylic type acids, bases or salts in particular for maintaining a certain basic pH).

The molecules of the filter according to the invention operate in a basic pH preferably larger than or equal to 8, which facilitates the preservation of the nicotine level as indicated earlier.

The acid, base and salt functions may either be added to the molecules according to the invention and/or to the other fibers of the filter substrate, or be located at their contact. They may also be used for halogenating the molecule of the active ingredient and/or of the other fibers of the filter substrate.

Highest cleanliness of the inhalated flux, combined with a clearing action on the tissues, provides a very favorable prognosis as to the limitation of cardiovascular, bronchopulmonary pathology and mutagenic or carcinogenic processes.

The filter has a general use for filtering contaminants and toxic products. In the case of filtration for a smoking item, the thereby described filter is not necessarily in contact with the tobacco; it may for example be housed within a cigarette holder.

During tests in the case of a smoking item, it was established that a few milligrams of active ingredient added to the mass of the filter in a moist medium matching that of a conventional cigarette filter, i.e. of the order of 7±2%, are sufficient for filtering nearly all the incriminated carcinogenic products in tobacco.

Generally, the mass of the nitrogen-containing cycles and nitrogen-containing heterocycles and in particular nitrogen-containing aromatic groups present in the filter accounts for at least 0.1% and preferably, more than 1% of the mass of the total mass of the filter.

Tests Performed

The tests were performed under the following conditions.

A cigarette filter with standard dimensions, injected with monocatenary filaments of salmon DNA consisting of about a thousand nucleotides, wherein the DNA mass is 10 mg per cigarette filter, the filter is dried before the smoking and dosage tests.

Moisture content: 7±2%, pH: about 8.

Control cigarettes used: Peter Stuyvesant™, both normal and "extra light".

Cigarettes used with a modified filter: normal Peter Stuyvesant™.

1) Comparison of normal Peter Stuyvesant ™, and modified Peter Stuyvesant ™ cigarettes

| | Normal Peter Stuyvesant ™ | Normal Peter Stuyvesant ™, with modified filter | Δ |
|---|---|---|---|
| Nicotine | 0.84 mg | 0.91 mg | ≡ |
| Tars | 11.4 mg | 12.5 mg | ≡ |
| Benzo(a)pyrene | 5.5 ng | 1.0 ng | −82% |
| B(a)P/nicotine | 6.55 | 1.10 | −83% |

2) Comparison of "extra light" Peter Stuyvesant ™ and modified normal Peter Stuyvesant ™ cigarettes

| | "Extra light" Peter Stuyvesant ™, | Normal Peter Stuyvesant ™, with modified filter | |
|---|---|---|---|
| Nicotine | 0.31 mg | 0.91 mg | |
| Tars | 3.8 mg | 12.5 mg | |
| Benzo(a)pyrene | 3.3 ng | 1.0 ng | −67% |
| B(a)P/nicotine | 9.68 | 1.10 | −89% |

Average contents expressed per cigarette.

Nicotine and tar measurements according to ISO standards 3402/4387/3308/10315/10362.

Benzo(a)pyrene measurements according to article "Marine D. C.; Tuck D. J.; Frost B. E.; benzo(a)pyrene analysis in main stream cigarette smoke, CORESTA meeting Hamburg 1999, abstr. ST3". Benzo(a)pyrene contents have been rounded to 0.5 ng/cigarette.

EXAMPLE OF FILTERS ACCORDING TO THE INVENTION

Example 1

Conventional cellulose acetate cigarette filter of about 200 mg. The filter is injected with salmon monocatenary DNA strands, with a length of about 2000 base pairs and with an amount equal to 10 mg for a current cigarette filter.

In a salt medium with 0,1% NaF.

Moisture content: 7±2%, pH: about 8.

Example 2

Conventional cellulose acetate cigarette filter of about 200 mg. The filter on its axis consists of a mixed compartment with salmon DNA filaments and polypropylene terephthalate fibers and a compartment consisting of the latter fibers exclusively. The mass of the DNA filaments represents 10 mg for a current cigarette filter.

In a salt medium with 0,1% NaF.

Moisture content: 7±2%, pH: about 8.

Example 3

Conventional cellulose acetate cigarette filter of about 200 mg. The cigarette filter consists of a mixture of salmon DNA linear filaments entangled with polypropylene terephthalate fibers. The mass of DNA filaments represents 10 mg for a current cigarette filter.

In a fluorine salt medium with 0.1% KF, NaF, $Na_2PO_3F$ in a ratio of 1:1:1.

Moisture content: 7±2%, pH: about 8.

What is claimed is:

1. A selective, direct chemical, anti-carcinogenic action filtration method for filtering toxic products, in particular polycyclic aromatic hydrocarbons (PAH) such as benzo(a) pyrene (BaP) and nitrosamines, contained in the tobacco smoke of a tobacco product to control the level of toxic products as compared with that of nicotine in order that the level reduction at the output of the filter is larger than a predetermined threshold, the method comprising steps of:

scavenging all or part of the toxic products by means of an active ingredient acting on said toxic products according to molecular processes comparable to those according to which DNA and/or RNA of the human cell react with regards to said toxic products, said active ingredient comprising molecules formed by one or more nitrogen-containing cycles or nitrogen-containing heterocycles in a chain of said molecules, or bound in a common chemical arrangement to one fiber, or both, controlling the operating conditions of the filter by operating in a substantially non-aqueous medium and with a basic pH, and adjusting the mass of the nitrogen-containing cycles or nitrogen-containing heterocycles to be larger than or equal to 0.1% of the mass of the filter.

2. The method according to claim 1, such that the molecule of the nitrogen-containing cycles or nitrogen-containing heterocycles is selected from the group consisting of DNA, RNA and derivatives thereof.

3. The method of claim 1, wherein the nitrogen-containing cycles or heterocycles are nitrogen-containing heteroaromatic cycles selected from the group consisting of pentacycles, hexacycles and combinations thereof.

4. The method of claim 1, wherein the active ingredient is adenosine triphosphate (ATP), cyclic adenosine monophosphate (AMP), or adenylcyclase.

5. A filter for a tobacco product with a selective, direct chemical, anti carcinogenic action, for filtering polycyclic aromatic hydrocarbons (PAH), notably benzo(a)pyrene (BaP), as well as nitrosamines, while preserving the nicotine level and taste aromas for the satisfaction and the pleasure of the smoker;

said filter including as active ingredient molecules formed by one or more nitrogen-containing cycles or nitrogen-containing heterocycles;

in the form of a chain of said molecules, or said molecules bound to a fiber in a common chemical arrangement, or both;

the mass of said nitrogen-containing cycles or heterocycles being at least equal to or larger than 0.1% of the total mass of the filter; and said nitrogen-containing cycles or heterocycles operating in a substantially non-aqueous medium and with a basic pH.

6. The filter according claim 5, such that the mass of said nitrogen-containing cycles or heterocycles is at least equal to or larger than 1% of the total mass of the filter.

7. The filter according to claim 5, such that the moisture content of the filter lies between 5 and 10%.

8. The filter according to claim 5, such that the molecule of the nitrogen-containing cycles or nitrogen-containing heterocycles is selected from the group consisting of DNA, RNA and derivatives thereof.

9. The filter according to claim 5, such that at least one function is added to the molecule of the active ingredient, on at least one of the nitrogen-containing cycles or nitrogen-containing heterocycles, the function being selected from the group consisting of amine $NH_2$, ketone, aldehyde, methyl, alkene, alkyl, and aryl.

10. The filter according to claim 5, such that one or more sugars is added to at least one molecule of the active ingredient.

11. The filter according to claim 5, such that one or more acid functions is added to at least one molecule of the active ingredient.

12. The filter according to claim 5, such that polymerization is performed at the nitrogen-containing cycles.

13. The filter according to claim 5, such that the molecule of the active ingredient includes a halogen in a form of one or more atoms, molecules, radicals, or ions.

14. The filter according to claim 5, such that the active ingredient includes a halogen salt medium.

15. The filter according to claim 5, such that said fibers are partly halogenated, and/or are in a medium including atoms, molecules, radicals or ions of a halogen.

16. The filter of claim 5, wherein the nitrogen-containing cycles or heterocycles are nitrogen-containing heteroaromatic cycles selected from the group consisting of pentacycles, hexacycles and combinations thereof.

17. The filter of claim 5, wherein the active ingredient is adenosine triiphosphate (ATP), cyclic adenosine monophosphate (AMP), or adenylcyclase.

18. A tobacco product including a filtration device that includes as active ingredient molecules formed by one or more nitrogen-containing cycles or nitrogen-containing heterocycles;

in the form of a chain of said molecules, or said molecules bound to a fiber in a common chemical arrangement, or both;

the mass of said nitrogen-containing cycles or heterocycles being at least equal to or larger than 0.1% of the total mass of the filter; and said nitrogen-containing cycles or heterocycles operating in a substantially non-aqueous medium and with a basic pH.

* * * * *

UNITED STATES PATENT AND TRADEMARK OFFICE

CERTIFICATE OF CORRECTION

PATENT NO. : 6,866,045 B1
DATED : March 15, 2005
INVENTOR(S) : Frederic Maillard et al.

It is certified that error appears in the above-identified patent and that said Letters Patent is hereby corrected as shown below:

Title page,
Item [54], Title, after "RNA" insert -- NOTABLY FOR FILTERING TOBACCO SMOKE AND A CIGARETTE INCLUDING SUCH A FILTER --.

Signed and Sealed this

Twenty-eighth Day of March, 2006

JON W. DUDAS
*Director of the United States Patent and Trademark Office*